US010541083B2

(12) United States Patent
Heo et al.

(10) Patent No.: US 10,541,083 B2
(45) Date of Patent: Jan. 21, 2020

(54) COIL UNIT FOR POWER INDUCTOR

(71) Applicant: SAMSUNG ELECTRO-MECHANICS CO., LTD., Suwon-si (KR)

(72) Inventors: Moon Seok Heo, Busan (KR); Chang Ho Lee, Busan (KR); Young Woong Song, Busan (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 0 days.

(21) Appl. No.: 16/160,325

(22) Filed: Oct. 15, 2018

(65) Prior Publication Data

US 2019/0051455 A1 Feb. 14, 2019

Related U.S. Application Data

(62) Division of application No. 14/819,026, filed on Aug. 5, 2015.

(30) Foreign Application Priority Data

Sep. 5, 2014 (KR) ..... 10-2014-0118546

(51) Int. Cl.
*H01F 41/04* (2006.01)
*H01F 5/00* (2006.01)
*H01F 17/00* (2006.01)

(52) U.S. Cl.
CPC ..... *H01F 41/041* (2013.01); *H01F 17/0006* (2013.01); *H01F 41/046* (2013.01); *H01F 2017/0066* (2013.01)

(58) Field of Classification Search
CPC ..... H01F 5/003; H01F 41/042; H01F 41/041
See application file for complete search history.

(56) References Cited

U.S. PATENT DOCUMENTS 4,392,013 A * 7/1983 Ohmura ..... H01L 21/705 174/253
4,416,056 A * 11/1983 Takahashi ..... G11B 5/313 29/602.1
5,729,887 A * 3/1998 Irie ..... G11B 5/313 29/602.1
6,600,404 B1 * 7/2003 Kajino ..... H01F 5/003 257/531

(Continued)

FOREIGN PATENT DOCUMENTS

JP 2001-267166 A 9/2001
JP 2001267166 A * 9/2001 ..... H01F 17/00

(Continued)

*Primary Examiner* — Elvin G Enad
*Assistant Examiner* — Malcolm Barnes
(74) *Attorney, Agent, or Firm* — NSIP Law

(57) ABSTRACT

The present invention relates to a coil unit for a power inductor, a manufacturing method of a coil unit for a power inductor, a power inductor and a manufacturing method of a power inductor. The coil unit includes an insulating substrate and a coil pattern, wherein the coil pattern has a first plating part formed at least one surface among top and bottom surfaces of the insulating substrate, wherein a top side thereof has the shape of a taper and a second plating part formed to encompass the first plating part and to correspond to a shape of the first plating part.

11 Claims, 6 Drawing Sheets

(56) References Cited

U.S. PATENT DOCUMENTS

| | | | | |
|---|---|---|---|---|
| 7,848,065 | B2 * | 12/2010 | Freitag | B82Y 25/00 360/324.12 |
| 2001/0024739 | A1 * | 9/2001 | Mizoguchi | H01F 17/0006 428/606 |
| 2003/0151849 | A1 * | 8/2003 | Sasaki | G11B 5/17 360/123.28 |
| 2004/0164835 | A1 * | 8/2004 | Shoji | H01F 17/0013 336/200 |
| 2005/0195062 | A1 * | 9/2005 | Yoshida | H01F 27/2804 336/200 |
| 2008/0108221 | A1 * | 5/2008 | Kim | C25D 1/00 438/652 |
| 2011/0140564 | A1 * | 6/2011 | Nomura | H01F 41/041 310/208 |
| 2012/0248570 | A1 * | 10/2012 | Golubovic | H01F 17/0006 257/531 |
| 2013/0222101 | A1 * | 8/2013 | Ito | H01F 17/04 336/83 |
| 2013/0300529 | A1 * | 11/2013 | Chang | H01F 5/003 336/173 |
| 2015/0035634 | A1 * | 2/2015 | Nakamura | H01F 17/0013 336/170 |
| 2015/0035640 | A1 * | 2/2015 | Wang | H01F 17/0006 336/200 |

FOREIGN PATENT DOCUMENTS

| | | | | |
|---|---|---|---|---|
| JP | 2001267166 | A | * | 9/2001 |
| KR | 1999-0053577 | A | | 7/1999 |

* cited by examiner

200

COIL UNIT FOR POWER INDUCTOR

CROSS-REFERENCE TO RELATED APPLICATIONS

This application is a divisional of application Ser. No. 14/819,026 filed on Aug. 5, 2015, which claims the benefit under 35 USC § 119(a) of Korean Patent Application No. 10-2014-0118546 filed on Sep. 5, 2014, in the Korean Intellectual Property Office, the entire disclosures of each of which are incorporated herein by reference for all purposes.

BACKGROUND OF THE INVENTION

1. Field of the Invention

The present invention relates to a coil unit for a power inductor, a manufacturing method of a coil unit for a power inductor, a power inductor and a manufacturing method of a power inductor.

2. Description of the Related Art

As an inductor device is one of major passive devices consisting of an electronic circuit together with a capacitor, it has been mainly used in a power circuit such as a DC-DC converter in the electronic device or widely used as a component to remove the noises or form an LC resonance circuit. Among those, particularly, according to requiring to the multi-driving such as communications, a camera and games in a mobile phone and a tablet PC or the like, the use of the power inductor has been gradually increased for reducing the loss of the current and for improving the efficiency.

The inductor device can be classified into various types such as a multi-layer, a winding type, a thin film type or the like according to the structure thereof; and, the thin film inductor device has been widely used according to the miniaturization and slimness of the recent electronic devices.

More particularly, the thin film type inductor can employ the material with high saturation magnetization value as well as, in case when it is manufactured with a small size, since the coil pattern is easily formed in comparison with the multi-layer inductor or the wiring type inductor, it has been widely used.

But, in case when the thin film type inductor is manufactured with smaller size, it also has the limit to increase the line width and the size of the coil pattern.

Accordingly, the efforts to increase the volume of the coil pattern have been continued through the use of ferrite material having higher saturation magnetization value in the aspect of material, a process capable of increasing a ratio, i.e., an aspect ratio, between the width and the thickness of the coil pattern at the aspect of process or a structural process capable of forming a high aspect ratio.

SUMMARY OF THE INVENTION

The present invention has been invented in order to overcome the above-described problems and it is, therefore, an object of the present invention to provide a coil unit for a power inductor, a manufacturing method of the coil unit for the power inductor, a power inductor and a manufacturing method of the power inductor capable of achieving miniaturization and implementing high inductance at the same size.

And, it is another object of the present invention to provide a coil unit for a power inductor, a manufacturing method of the coil unit for the power inductor, a power inductor and a manufacturing method of the power inductor capable of securing the reliability by easily coating an insulating material.

In accordance with one aspect of the present invention to achieve the object, there is provided a coil unit for a power inductor to form a second plating part to encompass a first plating part so as to be corresponding to a shape of the first plating part at the first plating part having a top side with a taper shape, and a power inductor employing the coil unit for the power inductor.

And also, the object of the present invention can be achieved by providing a manufacturing method of a coil unit for a power inductor employing a process of forming a second plating part to encompass a first plating part so as to be corresponded to the first plating part after etching a top edge of the first plating part, and a manufacturing method of the power inductor employing the manufacturing method of the coil unit for the power inductor.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERABLE EMBODIMENTS

Figure 1:
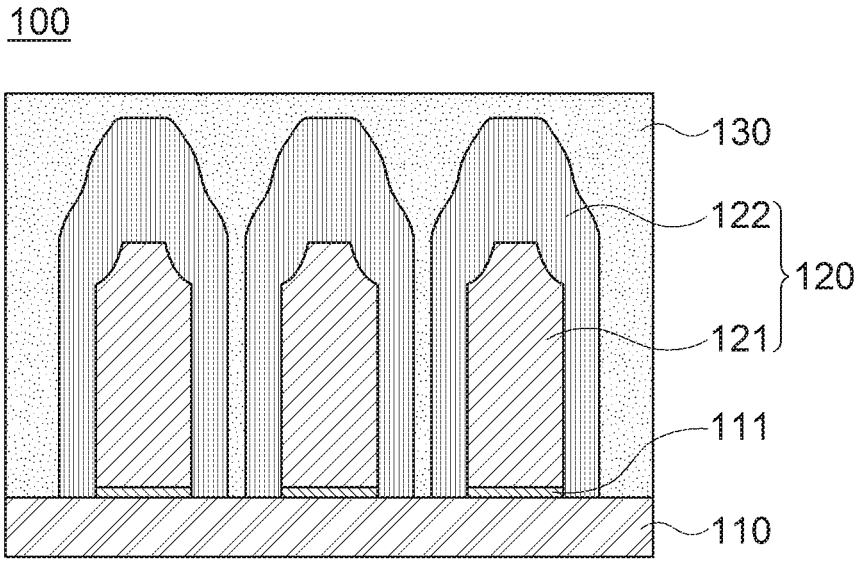
FIG. 1 is a cross-sectional view showing a coil unit for a power inductor in accordance with an embodiment of the present invention.

Hereinafter, preferred embodiments of the present invention will be described in detail. The following embodiments merely illustrate the present invention, and it should not be interpreted that the scope of the present invention is limited to the following embodiments.

In explaining the present invention, the drawing figures illustrate the general manner of construction, and descriptions and details of well-known features and techniques may be omitted to avoid unnecessarily obscuring the discussion of the described embodiments of the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

In explaining the present invention, when an element is referred to as being "connected" or "coupled" to another element, it can be "directly" connected or coupled to the other element or connected or coupled to the other element with another element interposed therebetween, unless it is referred to as being "directly connected" or "directly coupled" to the other element. Terms used herein are provided to explain embodiments, not limiting the present invention. Throughout this specification, the singular form includes the plural form unless the context clearly indicates otherwise. When terms "comprises" and/or "comprising" used herein do not preclude existence and addition of another component, step, operation and/or device, in addition to the above-mentioned component, step, operation and/or device.

Hereinafter, embodiments of the present invention will be described in detail with reference to the accompanying drawings so that those skilled in the art can easily practice the present invention.

<Coil Unit for Power Inductor>

FIG. 1 is a cross-sectional view showing a coil unit for a power inductor in accordance with an embodiment of the present invention.

As shown in FIG. 1, a coil unit 100 for a power inductor in accordance with an embodiment of the present invention includes an insulating substrate 110 and a coil pattern 120 formed on at least one among the top and the bottom surfaces of the insulating substrate 110 as a thin film inductor.

The insulating substrate 110 may be formed of a plate shape having a predetermined thickness as supporting the formed coil pattern 120.

And also, the insulating substrate 110 may be formed of an insulating material. For example, the insulating substrate 110 is formed of an epoxy insulating resin or at least one material selected among acrylic polymer, phenol-based polymer, polyimide polymer or the like. But, the present invention is not limited thereto, and various applications such as mixing at least two materials among those can be possible.

The coil pattern 120 includes a first plating part 121 and a second plating part 122.

The first plating part 121 may be formed in the shape of a coil wound at least once on the insulating substrate 110.

And also, the first plating part 121 may be formed of a conductive material, although it may be formed of any one selected from a group consisting of Ni, Al, Fe, Cu, Ti, Cr, Au, Ag, Pd or the like, but it is not limited thereto, and it is possible to form the first plating part 121 by mixing at least two metals from the above metals.

And also, the first plating part 121 can further include a seed layer 111 formed therebelow.

At this time, the seed layer 111 may be formed of the same material of the first plating part 121, it can be formed in a thin film shape on the insulating substrate 110 through an electroless plating or sputtering.

Accordingly, if the electroplating is performed by using the seed layer 111 formed on the insulating substrate 110 as a seed, the first plating part 121 can be formed by plating and growing the metal of the conductive material from the seed layer 111.

On the other hands, a top side of the first plating part 121 may be formed in the shape of a taper.

Herein, the first plating part 121, after a cross-section thereof is formed in the shape of a rectangle through the electroplating or the like, can be formed by etching the top edge.

At this time, the top edge part of the etched first plating part 121 may be formed in a curved shape or in an inclined shape having a predetermined slope.

That is, in the bottom of the first plating part 121, the cross-section is formed uniformly until a predetermined height at the top side, and it is formed with being gradually decreased as going from the predetermined height of the top side to the top portion.

If the top side of the first plating part 121 is not formed in the shape of a taper, when the second plating part 122 is formed through the electroplating, the current may be concentrated on the top edge of the first plating part 121. Accordingly, the growing speed of the top edge portion where the current is concentrated is speedy, and the short problem between the adjacent second plating parts 122 may be generated by growing and forming the second plating part 122 on the top edge portion intensively. And also, since the interval between the adjacent second plating part 122 is narrow, it may be difficult to form the following insulating layer 130.

Accordingly, by forming the top side of the first plating part 121 in the shape of a taper, since the present invention prevents the second plating part 122 from being intensively formed at a portion (top edge) of the first plating part 121, it can prevent the short problem between the adjacent second plating part 122 from being generated, and the insulating layer 130 can be easily formed.

The second plating part 122 may be formed to encompass the first plating part 121.

At this time, the second plating part 122, if the electroplating is performed by using the first plating part 121 as a seed, is formed by plating and growing the metal of the conductive material from the first plating part 121.

Accordingly, a top side of the second plating part 122 may be formed in the shape of a taper by forming with being corresponded to the shape of the first plating part 121.

And also, the thickness of the second plating part 122 encompassing the top surface of the first plating part 121 may be formed thicker than that of the second plating part 122 encompassing the side surface of the first plating part 121.

That is, by forming the top side of the first plating part 121 in the shape of a taper, when the second plating part 122 is formed through the electroplating, the growth of the top may be performed faster than the side surface of the first plating part 121. Finally, the thickness of the second plating part 122 encompassing the top surface of the first plating part 121 may be formed further thicker than that of the second plating part 122 encompassing the side surface of the first plating part 121.

Accordingly, the volume of the coil pattern 120 can be also secured with preventing the short problem between the adjacent second plating parts 122.

Therefore, the miniaturizations of the coil unit for the power inductor and the power inductor using the same can be achieved, in case when it is the same size of the prior art, there is an advantage to implement higher inductance.

On the other hands, the coil unit 100 for the power inductor in accordance with the embodiment of the present invention, as shown in FIG. 1, the insulating layer 130 may be formed so as to cover the surface, where the second plating part 122 is formed on the insulating substrate for the insulation, and the second plating part 122. But, the present invention is not limited thereto, and the second plating part 122 may be formed along the surface no to be exposed.

At this time, by forming the top side of the second plating part 122 in the shape of a taper as being corresponded to the first plating part 121 the gap between the adjacent second plating parts 122 can be formed that the top thereof is wider than the bottom.

Accordingly, since the insulating layer 130 is easily formed on the gap between the second plating parts 122 as well as the insulating layer 130 is formed to the second plating part 122 and the surface of the insulating substrate 110 through the gap between the adjacent second plating parts 122 to protect, whereby the reliability can be secured.

Although, in the embodiment of the present invention, it is explained that the coil pattern 120 of the coil unit 100 for the power inductor is formed on one surface of the insulating substrate 110, but the present invention is not limited thereto, and the coil pattern 120 may be formed on both sides of the insulating substrate 110. At this time, the coil pattern 120 on both surfaces of the insulating substrate 110 may be formed with the same structure described above.

<Manufacturing Method of Coil Unit for Power Conductor>

Hereinafter, the explanation for the manufacturing method of the coil unit for the power inductor in accordance with an embodiment of the present invention will be described in detail.

Figure 2:
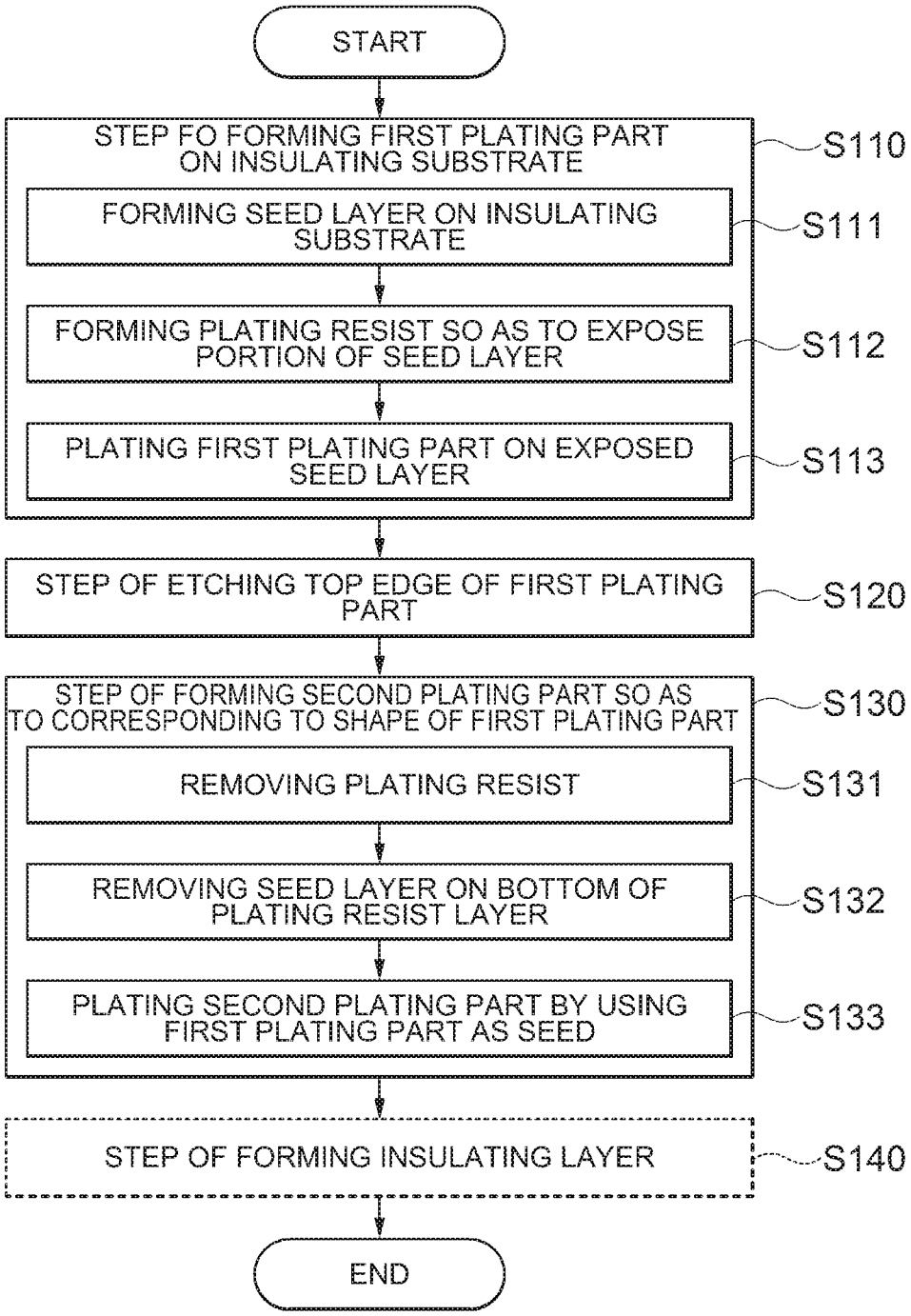
FIG. 2 is a flowchart showing a manufacturing method of a coil unit for a power inductor in accordance with an embodiment of the present invention.

FIG. 2 is a flowchart showing a manufacturing method of a coil unit for a power inductor in accordance with an embodiment of the present invention and FIG. 3 to FIG. 10 are cross-sectional views showing a manufacturing process of a coil unit for a power conductor in accordance with another embodiment of the present invention.

Referring to FIG. 2, the manufacturing method of the coil unit for the power inductor in accordance with the embodiment of the present invention can include forming a first plating part on at least one surface among top and bottom surfaces of an insulating substrate (S110), etching a top edge of the first plating part (S120) and forming a second plating part (S130) so as to be corresponded to a shape of the etched first plating part (S130). In addition, after the step (S130) forming the second plating part, the present invention further includes forming an insulating layer (S140).

Referring to FIG. 3 to FIG. 10, the manufacturing method of the coil unit for the power inductor in accordance with the embodiment of the present invention will be described in detail hereinafter.

Figure 3:
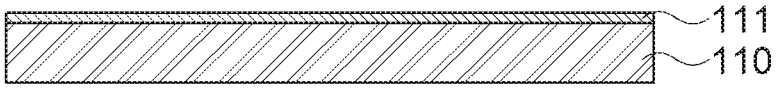
FIG. 3 is a cross-sectional view showing a process of forming a seed layer.
Figure 4:
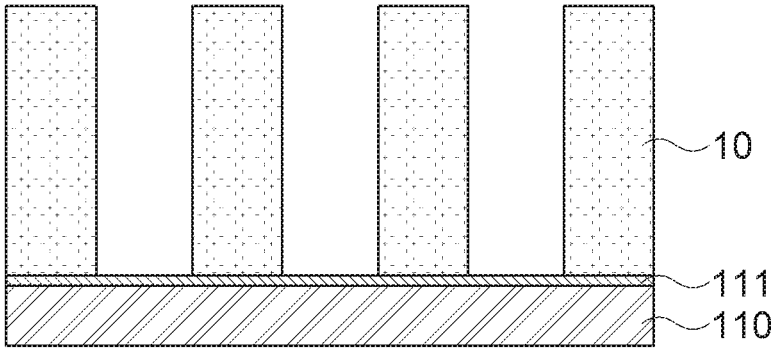
FIG. 4 is a cross-sectional view showing a process of forming a plating resist layer.
Figure 5:
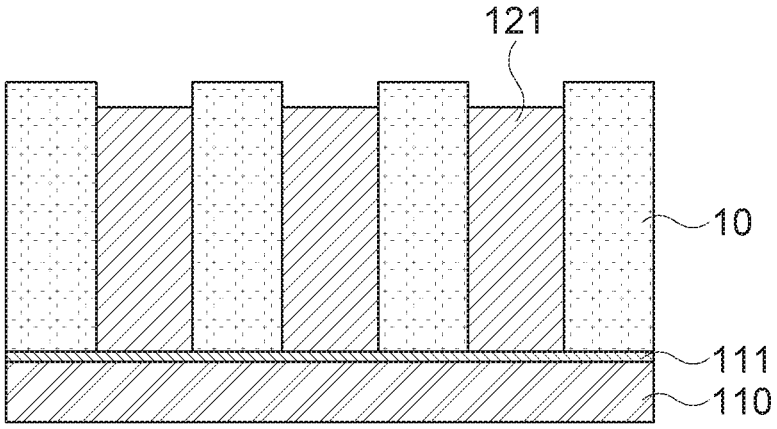
FIG. 5 is a cross-sectional view showing a process of forming a first plating part.

At first, FIG. 3 to FIG. 5 are cross-sectional views showing the step (S110) of forming a first plating part on an insulating substrate.

As shown in FIG. 3 to FIG. 5, the step (S110) of forming the first plating part on at least one surface among top and bottom surfaces of the insulating substrate can include a step (S111) of forming a seed layer on at least one surface among the top and the bottom surfaces of the insulating substrate, a step (S112) of forming a plating resist layer on the seed layer so as to expose a portion of the seed layer and a step (S113) of plating the first plating part on the exposed seed layer.

As shown in FIG. 3, the seed layer 111 can be formed on one surface of the insulating substrate 110.

Herein, as the seed layer 111 is used as a seed to form the first plating part through the plating process, it can be formed of the conductive material. For example, although it can be made of any one selected from a group consisting of Ni, Al, Fe, Cu, Ti, Cr, Au, Ag, Pd or the like, but the present invention is not limited thereto, and the seed layer 111 can be formed by mixing at least two among the metals.

At this time, the seed layer 111 can be formed on one surface of the insulating substrate 110 through the electroless plating or the sputtering method.

And also, as shown in FIG. 4, the plating resist layer 10 can be formed on the seed layer 111 so as to exposed a portion of the seed layer 111 (S112).

Herein, the plating resist layer 10, when proceeding the plating process as the following process, as the plating is prevented from being proceeded on the remaining region except the portion to form the first plating part 121, can form except the region to form the first plating part 121.

At this time, the plating resist 10 may be a dry film or a photoresist. For example, in case when the plating resist layer 10 is the dry film, the seed layer 111 can be exposed by attaching the dry film on the seed layer 111, exposing and developing the portion to form the first plating part 121 and removing the portion of the dry film to form the first plating part 121. Or, in case when the plating resist layer 10 is a liquid type photoresist, after the liquid type photoresist is coated on the seed layer 111 and hardened by being exposed, by removing the portion of the photoresist to form the first plating part 121 by being developed, the seed layer 111 can be exposed. But, the present invention cannot be limited thereto, if the plating is prevented from being coated on the remaining region except the portion to form the first plating part 121, any type plating resist is possible.

And, as shown in FIG. 5, the first plating part 121 can be coated on the exposed seed layer 111 (S113).

Herein, the first plating part 121 can be formed by plating and growing the metal made of conductive material from the seed layer 111 by performing the electroplating using the seed layer 111 as a seed.

At this time, the cross-section of the first plating part 121 may be a rectangle, and the first plating part 121 can be formed of the same material of the seed layer 111.

Figure 6:
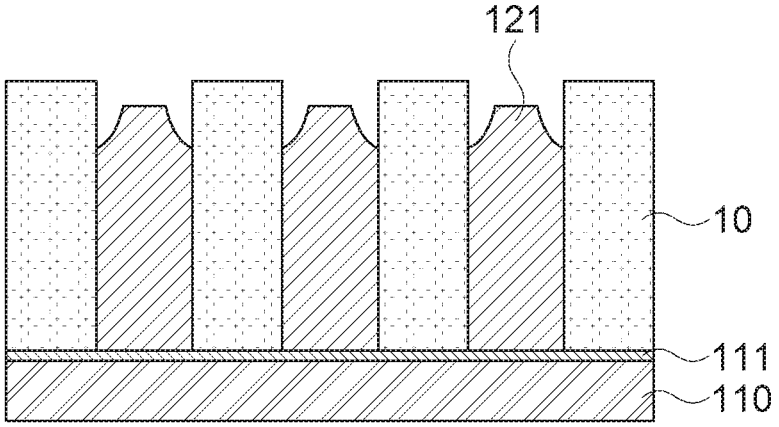
FIG. 6 is a cross-sectional view showing a process of etching the first plating part.

Thereafter, FIG. 6 is a cross-sectional view showing a step (S120) for etching the top edge of the first plating part.

As shown in FIG. 6, the top edge of the first plating part 121 can be etched.

Herein, at the state that the plating resist layer 10 is not removed, the plated first plating part 121 can be etched through the wet etching using an acid type etchant. But, the present invention cannot be limited thereto, if the first plating part 121 made of the metal material can be etched, any one is possible.

At this time, only the top edge of the first plating part 121 of which cross-section is a rectangle can be etched at the present step.

At this time, when performing the etching through the etchant under the state that the plating resist layer 10 is not removed, since the etching is started from the interface between the first plating part 121 and the plating resist layer 10 made of the materials different from each other, only top edge of the first plating part 121 can be etched by controlling the etching time.

At this time, the etched portion of the first plating part 121 can be formed in the curved shape with the slope to be larger or smaller as going from the bottom to the top portion or in the inclined shape to have a predetermined slope.

That is, by etching only the top edge of the first plating part 121 of which the cross-section is formed in the shape of a rectangle through the plating process at the above step, the first plating part 121 can be formed in the taper shape of which the cross-section is formed uniformly from the bottom portion to a predetermined height of the top side and becomes gradually narrower as going from the predetermined height of the top side to the top portion.

In case when the top side of the first plating part 121 is not formed in the taper shape, in the following step of forming the second plating part 122, the current may be concentrated on the top edge of the first plating part 121. Accordingly, since the second plating part 122 is intensively formed on the top edge portion by rapidly growing the top edge portion of the first plating part 121 where the current is concentrate, the short problem may be generated between the adjacent second plating parts 122.

Accordingly, since the top side is formed in the taper shape by etching the top edge of the first plating part 121 at the present step, when the following process to form the second plating part 122 is performed, the present invention can prevent the second plating part 122 from being concentrated at the portion (top edge) of the first plating part 121.

Figure 7:
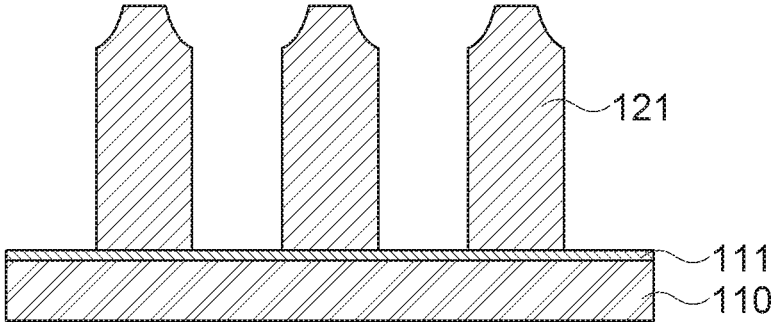
FIG. 7 is a cross-sectional view showing a process of removing the plating resist layer.
Figure 8:
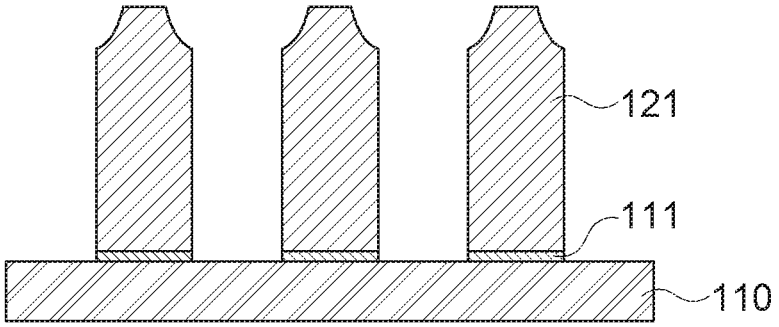
FIG. 8 is a cross-sectional view showing a process of removing the seed layer.
Figure 9:
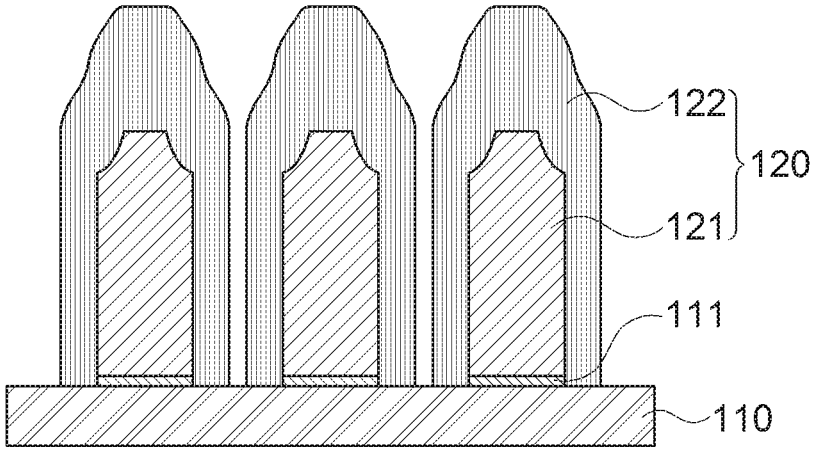
FIG. 9 is a cross-sectional view showing a process of forming a second plating part.

Thereafter, FIG. 7 to FIG. 9 are cross-sectional views showing a step (S130) of forming the second plating part.

As shown in FIG. 7 to FIG. 9, the step (S130) can include a step (S131) of removing the plating resist layer, a step (S132) of removing a seed layer on a bottom of the plating resist layer and a step (S133) of plating the second plating part so as to be corresponded to the shape of the first plating part using the first plating part as a seed.

First, as shown in FIG. 7, the plating resist layer 10 can be removed (S131).

And, as shown in FIG. 8, the seed layer 111 on the bottom of the plating resist layer 10 can be removed (S132).

That is, the insulating substrate 110 can be exposed by removing the remaining seed layer 111 except the seed layer where the first plating part 121.

At this time, although the seed layer 111 can be removed through a flash etching method to spray the etchant, but the present invention is not limited thereto.

And also, as shown in FIG. 9, the second plating part 121 can be plated so as to be corresponded to the shape of the first plating part 121 using the first plating part 121 as a seed (S133).

Herein, if performing the electroplating using the first plating part 121 as a seed, the second plating part 122 can be formed by plating and growing the metal made of the conductive material from the first plating part 121.

At this time, since the second plating part 122 is formed by being corresponded to the shape of the first plating part 121, the top side thereof can be formed in the taper shape.

Specifically, the thickness of the second plating part 122 to encompass the top surface of the first plating part 121 can be formed thicker than that of the second plating part 122 to encompass the side surface of the first plating part 121.

That is, by forming the top side of the first plating part 121 in the taper shape at the previous step, when the second plating part 122 can be formed through the electroplating using the first plating part 121 as a seed, the top portion of the first plating part 121 can be rapidly grown in comparison with the side surface thereof. At this time, since the plating growth speed of the edge part of the top portion of the first plating part 121 is rapid in comparison with the remaining portion, the area of the top portion can be also secured.

Accordingly, the thickness of the second plating part 122 to encompass the top surface of the first plating part 121 can be formed thicker than that of the second plating part 122 to encompass the side surface of the first plating part 121.

Therefore, the volume of the coil pattern 120 can be secured with preventing the short problem between the adjacent second plating parts 122, the minimization of the coil unit for the power inductor can be achieved; and, in case when the size thereof is equal to that of the prior art, the high inductance can be implemented.

Figure 10:
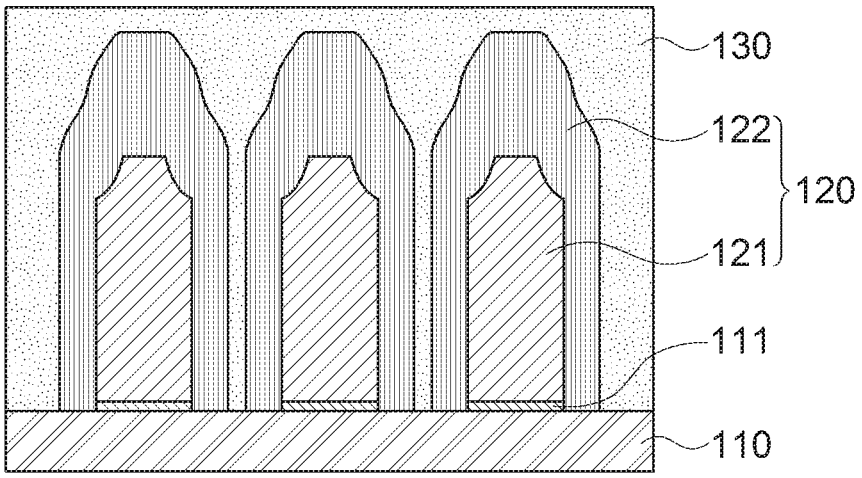
FIG. 10 is a cross-sectional view showing a process of forming an insulating layer.

Thereafter, the manufacturing method of the coil unit for the power inductor in accordance with the embodiment of the present invention, as shown in FIG. 2 and FIG. 10, after the step (S130) of forming the second plating part 122, can further include the step (S140) of forming the insulating layer 130.

Herein, as shown in FIG. 10, the insulating layer 130 can be formed so as to cover the surface of the insulating substrate 110 where the second plating part 122 is formed for the insulation and the second plating part 122. But, the method for forming the insulating layer 130 of the present invention is not limited thereto, and the insulating layer 130 can be formed along the surface of the second plating part 122 not to expose the second plating part 122.

At this time, the insulating layer 130 can be formed by coating the insulating material fused in the shape of a paste on the surface of the insulating substrate 110 formed thereon the second plating part 122. But, the present invention is not limited thereto, if the insulating layer 130 can be formed not to expose the second plating part 122 for the insulation, any method is possible.

On the other hands, by forming the second plating part 122 to have its top side in the taper shape, the gap between the adjacent second plating parts 122 is formed in such a way that its top portion is wider than the bottom.

Accordingly, the second plating part 122 is formed in such a way that the top of the gap between the adjacent second plating parts 122 is wider than the bottom thereof by forming the top side in the taper shape.

Accordingly, in case when the fused insulating material is coated on the surface of the insulating substrate 110 formed thereon the second plating part 122, the fused insulating material can be penetrated into the gap between the second plating parts 122 easily; and, since the insulating layer 130 is formed to the surface of the insulating substrate 110 and the bottom of the second plating part 122 to protect the second plating part 122, the reliability can be secured.

<Power Inductor and Manufacturing Method of Power Inductor>

Figure 11:
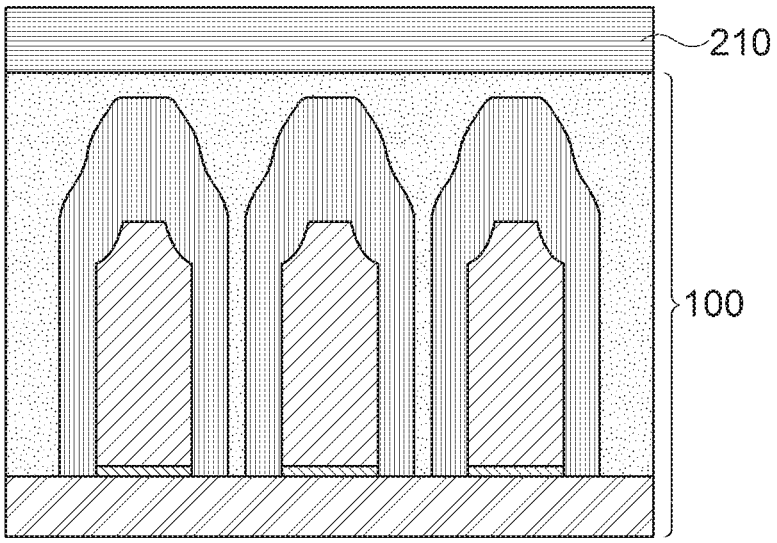
FIG. 11 is a cross-sectional view showing a power inductor in accordance with an embodiment of the present invention.

FIG. 11 is a cross-sectional view showing a power inductor in accordance with an embodiment of the present invention.

As shown in FIG. 11, the power inductor 200 in accordance with the embodiment of the present invention may be formed by including a magnetic material 210 connected to the coil unit 100 for the power inductor in accordance with the embodiment of the present invention as shown in FIG. 1.

At this time, although the embodiment of the present invention exemplifies the case that the magnetic material 210 is connected to one surface where the coil pattern 120 of the coil unit 100 for the power inductor, but the present invention is not limited thereto, in case of the coil unit 100 for the power inductor that the coil pattern 120 is formed on the top and the bottom surface thereof, the power inductor 200 can be formed by connecting the magnetic material 210 to all the top and the bottom surfaces. And also, even in case of the coil unit 100 for the power inductor where the coil pattern 120 is formed on only one surface, the power inductor 200 can be formed by connecting the magnetic material 210 to the top and the bottom surfaces.

On the other hands, in case when the magnetic material 210 is connected to the coil unit 100 for the power inductor, it can be bonded by using polymer such as epoxy or polymer or the other adhesive.

And also, although the magnetic material 210 can use a conventional ferrite powder as it is, but the material to form the ferrite on a glass or the other substrate can be used as the magnetic material as well as a soft magnetic layer formed with the thin film manufacturing process or a multi-layered insulating layer can be used.

On the other hands, the power inductor 200 shown in FIG. 11, after forming the coil unit 100 for the power inductor formed according to the manufacturing method of the embodiment of the present invention described above, that is, the coil unit 100 for the power inductor shown in FIG. 10, can be formed by including a step of connecting the magnetic material 210 to at least one among the top and the bottom surfaces of the coil unit 100 for the power inductor.

The above-described coil unit for the power inductor, the manufacturing method of the coil unit for the power inductor, the power inductor and the manufacturing method of the power inductor can achieve the miniaturization, can implement high inductance at the same size and can obtain the reliability.

As described above, although the preferable embodiments of the present invention have been shown and described, it will be appreciated by those skilled in the art that substitutions, modifications and variations may be made in these embodiments without departing from the principles and spirit of the general inventive concept, the scope of which is defined in the appended claims and their equivalents.

Therefore, the scope of the present invention is not limited to the described embodiments, but it is defined by claims as well as all modifications, equivalents and substitutions of claims.

What is claimed is:

1. A coil unit for a power inductor, comprising:
an insulating substrate; and
a coil pattern, comprising:
a first plating part, formed on one of a top surface and a bottom surface of the insulating substrate, arranged at a middle portion of the coil pattern, and tapered at a top side thereof so as to become narrower toward the top side thereof; and
a second plating part, formed to envelop a side surface and a top surface of the first plating part, and tapered at a top side thereof to correspond to the tapered top side of the first plating part,
wherein the first plating part comprises a seed layer, and a width of the seed layer and a width of an abutting surface of the first plating part are substantially the same, and
wherein the second plating part covers the side surface of the first plating part and a side surface of the seed layer.

2. The coil unit for a power inductor according to claim 1, wherein a thickness of the second plating part enveloping the top surface of the first plating part is thicker than that of the second plating part enveloping the side surface of the first plating part.

3. The coil unit for a power inductor according to claim 1, wherein the seed layer is formed on a bottom surface of the first plating part.

4. The coil unit for a power inductor according to claim 1, further comprising an insulating layer formed to cover the second plating part and the top surface or the bottom surface of the insulating substrate on which the second plating part is formed.

5. The coil unit for a power inductor according to claim 1, further comprising an insulating layer formed along a surface of the second plating part.

6. A power inductor comprising:
the coil unit for a power inductor according to claim 1; and
a magnetic material connected to at least one of top and bottom surfaces of the coil unit for the power inductor.

7. The coil unit for a power inductor according to claim 1, wherein the coil pattern comprises a plurality of coil patterns.

8. The coil unit for a power inductor according to claim 7, wherein an insulating layer is disposed to abut an upper surface of the second plating part of each of the plurality of coil patterns.

9. A coil unit for a power inductor, comprising:
an insulating substrate; and
a coil pattern, comprising:
a first plating part, formed on one of a top surface and a bottom surface of the insulating substrate, arranged at a middle portion of the coil pattern, and tapered at a top side thereof so as to become narrower toward the top side thereof; and
a second plating part, formed to envelop a side surface and a top surface of the first plating part, and tapered at a top side thereof to correspond to the tapered top side of the first plating part,
wherein the first plating part comprises a seed layer, and a height of the seed layer and a height of the first plating part are substantially different, and
wherein the second plating part covers the side surface of the first plating part and a side surface of the seed layer.

10. The coil unit for a power inductor according to claim 9, wherein the coil pattern comprises a plurality of coil patterns.

11. The coil unit for a power inductor according to claim 10, wherein an insulating layer is disposed to abut an upper surface of the second plating part of each of the plurality of coil patterns.

* * * * *